US007677674B2

(12) United States Patent
Brandl et al.

(10) Patent No.: US 7,677,674 B2
(45) Date of Patent: Mar. 16, 2010

(54) CUTTING MACHINE

(75) Inventors: Erich Brandl, Grosslobming (AT); Kurt Schaffer, Seckau (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 337 days.

(21) Appl. No.: 11/791,379

(22) PCT Filed: Nov. 24, 2005

(86) PCT No.: PCT/AT2005/000476

§ 371 (c)(1),
(2), (4) Date: May 23, 2007

(87) PCT Pub. No.: WO2006/056000

PCT Pub. Date: Jun. 1, 2006

(65) Prior Publication Data

US 2007/0296262 A1 Dec. 27, 2007

(30) Foreign Application Priority Data

Nov. 26, 2004 (AT) ..... A 1996/2004

(51) Int. Cl.
*E21C 27/24* (2006.01)

(52) U.S. Cl. ..... 299/64; 299/75; 299/78

(58) Field of Classification Search ..... 299/64, 299/75, 78

See application file for complete search history.

(56) References Cited

U.S. PATENT DOCUMENTS

| | | | | |
|---|---|---|---|---|
| 4,669,560 | A | 6/1987 | Wilcox, Jr. et al. | |
| 5,333,936 | A * | 8/1994 | Zitz | 299/64 |
| 6,168,240 | B1 * | 1/2001 | Stickel et al. | 299/12 |

FOREIGN PATENT DOCUMENTS

| | | | |
|---|---|---|---|
| AT | 393 295 | B | 9/1991 |
| AT | 404 863 | B | 3/1999 |
| DE | 40 18 154 | A1 | 12/1990 |

* cited by examiner

*Primary Examiner*—John Kreck
(74) *Attorney, Agent, or Firm*—Chapman and Cutler LLP

(57) ABSTRACT

In a cutting machine (1) with cutting heads or rollers (7) rotationally mounted on a pivotable cutting arm (6), including a loading ramp or a conveyor (9) extending in the direction to the mine face for receiving and removing the cut material, wherein the cutting arm (6) is mounted on a carriage (4) displaceable on guides extending in the longitudinal direction of the machine, the carriage (4) carries guide rods (12) extending in the longitudinal direction of the machine and engaging in tubular guides (13) of the machine frame (3) carrying a chassis (2).

20 Claims, 4 Drawing Sheets

CUTTING MACHINE

The invention relates to a cutting machine with cutting heads or rollers rotationally mounted on a pivotable cutting arm, including a loading ramp or a conveyor extending in the direction to the mine face for receiving and removing the cut material, wherein the cutting arm is mounted on a carriage displaceable on guides extending in the longitudinal direction of the machine.

Cutting machines or mining machines in which the excavation tools are displaceable relative to the machine frame on a carriage may, for instance, be taken from AT 393295 B. In that known mining machine, guide rods are provided on the frame of the mining machine within the crawler mechanisms, on which guide rods a carriage is displaced. To this end, the carriage comprises tubular guides, whereby the respective displaceability along the guide rods is ensured in that the axial lengths of the tubular guides are shorter than the axial lengths of the guide rods. In those known devices, haulage means are articulately movable along with that carriage within links.

From AT 407422 B, a modified carriage with longitudinal beams has become known, which comprises a portal-like cross member. That carriage, by tube pieces or tubular guides, again encompasses the guide rods arranged within the frame of the crawler mechanism.

With particularly low-structured machines, the attainment of the required rigidity and sturdiness is difficult because of the reduced structural dimensions. For this reason, it has already been proposed to design frame components as box sections. Thus, a carriage formed as a self-supporting box section and mounted on the frame so as to be displaceable in longitudinal guides formed by rods can, for instance, be taken from AT 404863 B and AT 404282 B. The rod-shaped longitudinal guides are again connected with the frame of the crawler mechanism, the conveyor in that configuration having to be moved through the clear cross section of the carriage designed as a self-supporting box section.

The invention aims to provide a mining machine including a frame carriage structure for low seams, which is suitable for particularly low seams and offers an improved mobility on crowns and ditches. To solve this object, the mining machine configuration according to the invention, of the initially defined kind consists essentially in that the carriage carries guide rods extending in the longitudinal direction of the machine and engaging in tubular guides of the machine frame carrying a chassis. Due to the fact that the construction principle for the frame carriage structure has now been modified to the effect that the tube is connected with the carriage and the guide rods are fixed to the frame, it has become feasible to make the machine frame with the crawler mechanisms particularly stable with relatively short tubular guides and, at the same time, guide the carriage connected with the rod in an accordingly tiltable manner, since the relatively long guide rods of the carriage are guided in relatively short tube pieces of the machine frame. Such tiltability can be further enhanced in that, as in correspondence with a preferred further development of the configuration according to the invention, the tubular guides have curved generatrices while forming spherical inner contours. The tubular guides are in a particularly simple manner suitable for the formation of a particularly stable, low-structured machine frame, wherein such a machine frame may altogether be built in a relatively short-structured fashion without losing the required rigidity and strength. Concerning the use of conveyors, fewer limitations are to be accepted than with box sections, which form the carriage, since the conveyor is actually taken along by the carriage in the longitudinal direction of the machine. In accordance with the invention, the configuration is, therefore, advantageously devised such that the carriage is designed as an upwardly open chute in whose side cheeks the pivot axis for the vertical pivoting of the cutting arm is arranged. Such an upwardly open chute can be adjusted over a relatively long axial displacement path without causing collisions of the conveyor with frame components of the machine frame.

In a particularly advantageous manner, the configuration is devised such that the tubular guides are arranged between crawler mechanisms and connected to a frame by braces or plates extending transversely to the tube axes, whereby a high stability of the machine frame will be safeguarded at small dimensions. The tubular guides in this case may accordingly be welded both with the crawler mechanisms and with the connection plates so as to yield a particularly compact and torsion-stiff structure.

The short mode of construction, at the same time, allows the machine frame itself to be subdivided in the axial direction and thereby enhance its flexibility, which, in turn, serves to enhance the mobility on crowns and ditches. To this end, the configuration is advantageously devised such that a frame part capable of being pivoted about at least one pivot axis extending transversely to the longitudinal direction of the machine is articulately connected to the frame comprising the tubes. An articulately pivotable frame part thus arranged in the rear part of the machine can be lifted in the vertical direction in order to reach the desired delivery height of the conveyor, wherein an enhanced curve-going mobility, is obtainable by an additional pivotability of a frame part in the rear region of the machine.

In this respect, the configuration is advantageously devised such that, on the rear end of the carriage facing away from the cutting arm, a pivot axis extending transversely to the longitudinal axis of the machine is arranged for the conveyor or the conveying chute so as to enable relatively heavy components such as the energy supply for the machine drives to be laterally pivoted in curves. It is an essential advantage over known constructions to ensure any pivotability without entailing the risk of the conveyor colliding with other machine parts, to which end, the configuration, as already mentioned, is advantageously devised such that the conveyor chute is designed as an upwardly open chute over the entire length of the conveyor.

The pivotability of the rear machine part, or pivotable rear frame part articulately connected with the machine frame, can even be further enhanced in that said rear frame part is cardanically connected to the frame part comprising the tubular guide.

In the following, the invention will be explained in more detail by way of an exemplary embodiment schematically illustrated in the drawing. Therein:

Figure 1:
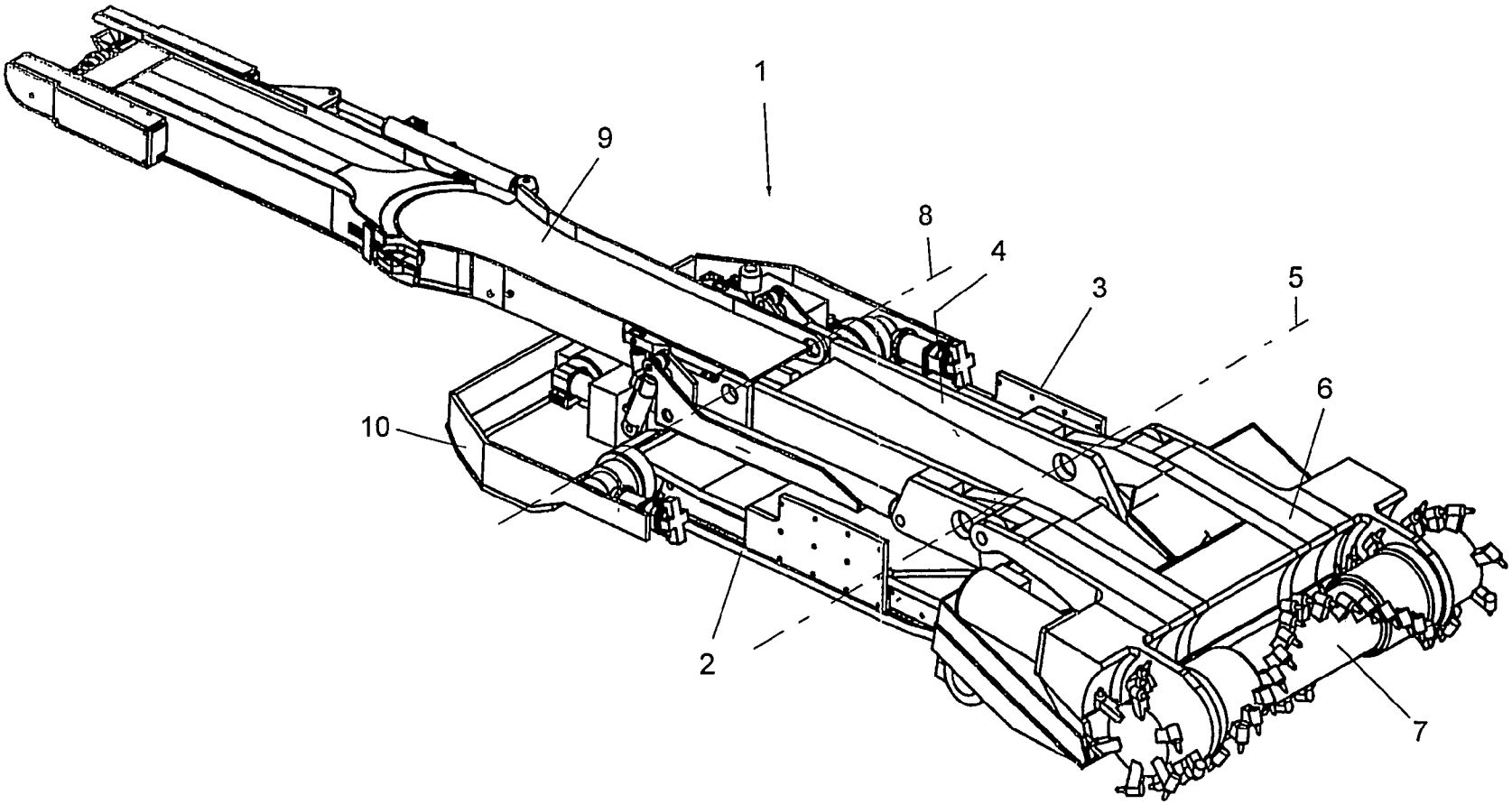
FIG. 1 is a perspective overall view of the machine according to the invention in a schematic illustration.

FIG. 1 depicts a mining machine 1 whose crawler mechanism 2 is connected with a machine frame 3. On this machine frame, a carriage 4 is displaceable in the longitudinal direction of the machine, wherein a cantilever or cutting arm 6 including a rotationally mounted cutting roller 7 is articulated to the carriage 4 so as to be vertically pivotable about a horizontal pivot axis schematically indicated at 5.

On the rear end of the carriage 4, which has an upwardly open chute-shaped profile, is provided a further frame part 9, which is vertically pivotable about a pivot axis 8 and by means of which a conveyor arranged in the chute can be pivoted in the vertical direction in order to adjust the desired delivery height. On the machine frame 2, another pivotable rear frame part 10 is, however, also arranged, which can laterally be pivoted out in curves, as will be explained in more detail by way of the following Figures.

Figure 2:
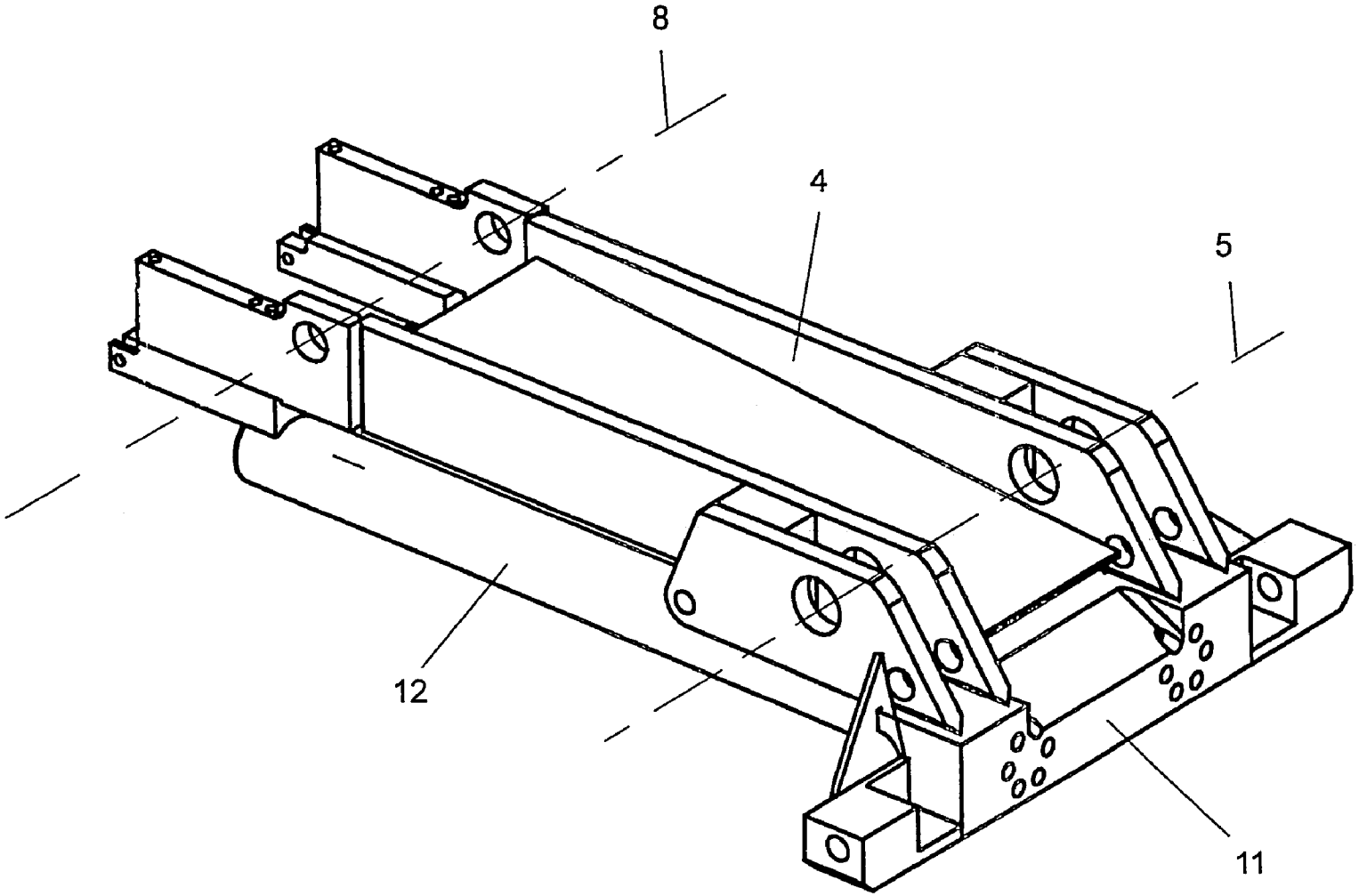
FIG. 2 shows the frame that is displaceable in the longitudinal direction of the machine in an enlarged illustration.
Figure 3:
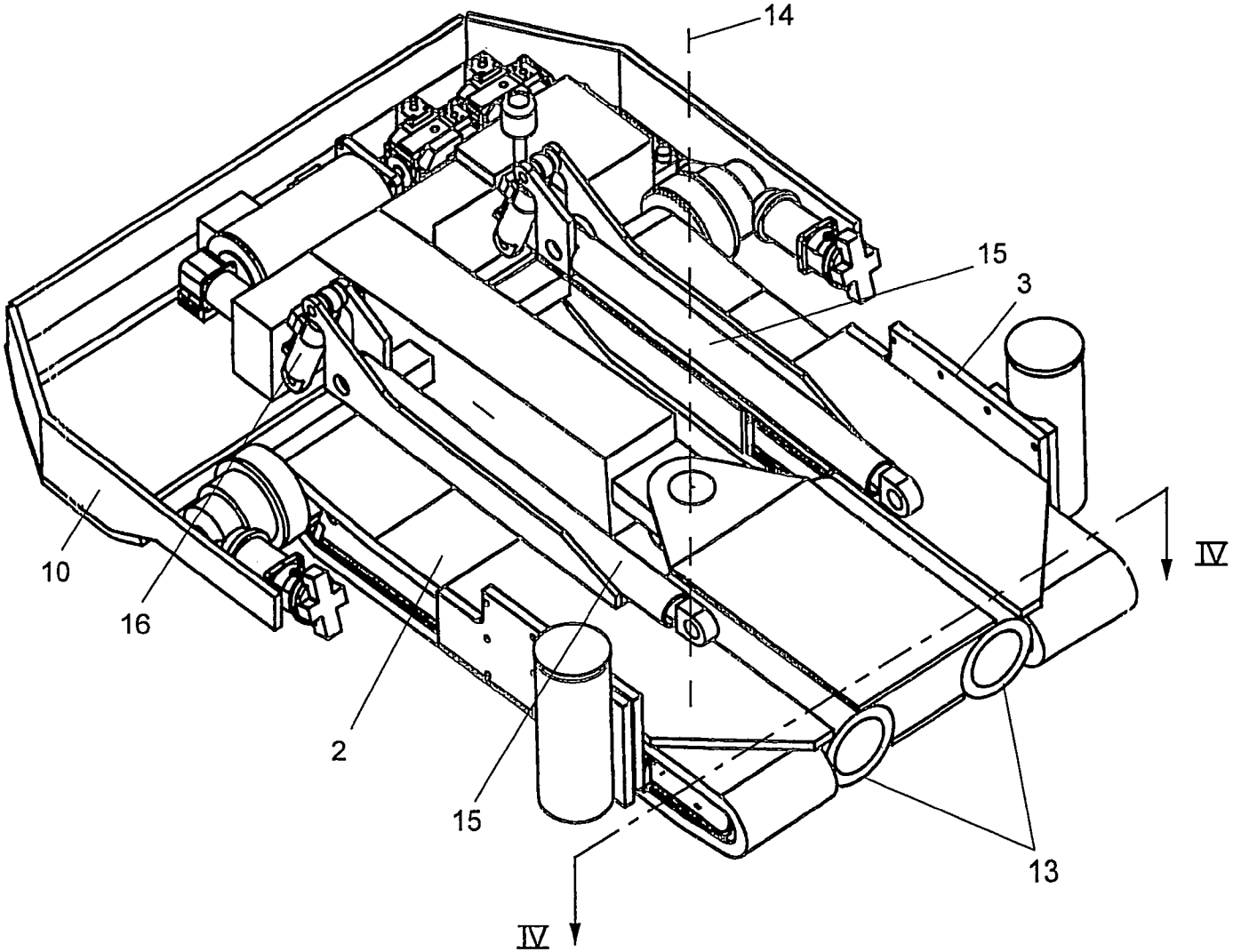
FIG. 3 depicts the machine frame with the rear, pivotable frame part articulately connected to the machine frame.

In FIG. 2, the carriage 4 is illustrated on an enlarged scale with the cantilever arm 6 having been removed. From this, the end carrier 11 connected with the carriage 4 and carrying the guide rods 12 is clearly apparent. These guide rods 12 are inserted in appropriate, tubular guides of the machine frame, said tubular guides being denoted by 13 in FIG. 3. From FIG. 3, the machine frame with the crawler mechanism 2 is apparent, the latter being comprised of a first frame 3 supporting the tubular guides 13 and a frame part 10 which is pivotable about a substantially vertical axis 14. The illustration according to FIG. 3 depicts pivot cylinders 15 for the vertical pivoting of the cantilever arm 6 as shown in FIG. 1 as well as further pivot cylinders 16 for the respective adjustment of the second frame part 10 relative to the first frame part 3 connected with the crawler mechanism. To this end, the axis schematically indicated by 14 is not designed as a merely vertical pivot axis, but as a spherical bearing allowing for a cardanic pivotability even transverse to the axis 14. Similarly, the inner contour of the tubular guides is formed by curved generatrices rather than straight generatrices, so that the rods 12 are guided with appropriate plays within the guides 13, which allow for a tilting movement about an axis extending substantially parallel with the bottom plane.

Figure 4:
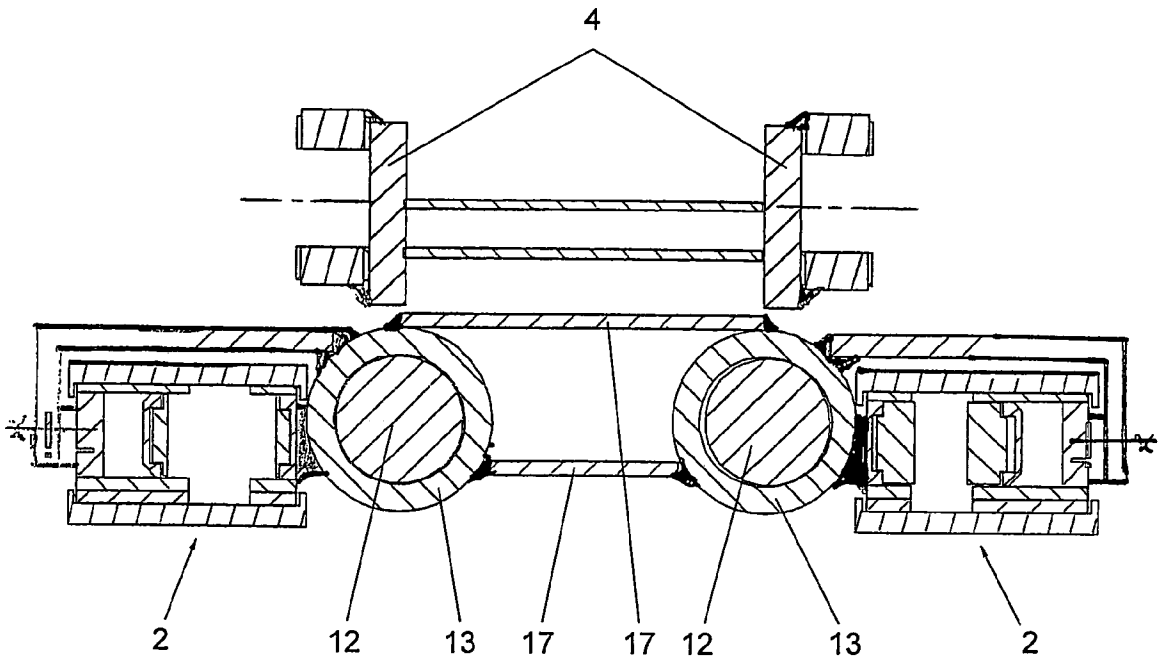
FIG. 4 is a sectional illustration along line IV-IV of FIG. 3 with the carriage inserted in the machine frame.

The illustration according to FIG. 4 depicts the frame structure in a sectional view, with the rods 12 of the carriage 4 being now inserted in the tubular guides 13. The tubular guides are each welded with the crawler mechanism 2 and interconnected via plates 17 to form a particularly rigid, box-shaped frame component. The guide rods 12, which are inserted in the tubular guides 13 and whose axial lengths are larger than the axial lengths of the tubular guides, can be guided within the tubular guides with appropriate plays, and it is clearly apparent from FIG. 4 that the carriage, in cross section, forms an upwardly open U-section, thus constituting an upwardly open chute for the conveyor.

Due to an extremely low mode of construction at a simultaneous maximum of flexibility, the mobility on crowns and ditches as well as the curve-going ability of the mining or cutting machine are substantially enhanced in this configuration.

The invention claimed is:

1. A cutting machine, comprising:

a machine frame (3) carrying a chassis;

cutting heads or rollers rotationally mounted on a pivotable cutting arm (6);

a conveyor extending in the direction of a mine face for receiving and removing cut material; and a carriage displaceable on guides extending in a longitudinal direction of the machine, wherein the cutting arm (6) is pivotably mounted on the carriage (4);

the carriage (4) carries guide rods (12) extending in the longitudinal direction of the machine;

the guide rods (12) engage with tubular guides (13) of the machine frame (3); and the tubular guides (13) are arranged between crawler mechanisms (2), and the tubular guides (13) are connected to one another by braces or plates (17) extending transversely to longitudinal axes of the tubular guides (13).

2. A cutting machine according to claim 1, wherein the carriage (4) is designed as an upwardly open chute comprising side cheeks in which is positioned a pivot axis (5) for vertical pivoting of the cutting arm (6).

3. A cutting machine according to claim 1, wherein the tubular guides (13) are arranged in a forward region of the crawler mechanisms (2).

4. A cutting machine according to claim 1, wherein a frame part (9) capable of being pivoted about at least one pivot axis (8) extending transversely to the longitudinal direction of the machine is articulately connected to the frame (3) comprising the tubular guides (13).

5. A cutting machine according to claim 1, wherein, on a rear end of the carriage (4) facing away from the cutting arm (6), a pivot axis (8) extending transversely to the longitudinal axis of the machine is positioned for pivot of a rear part of the conveyor or a conveying chute.

6. A cutting machine according to claim 1, further comprising a conveyor chute that is designed as an upwardly open chute over an entire length of the conveyor.

7. A cutting machine according to claim 1, further comprising a pivotable, rear frame part (10) articulately connected with the machine frame (3), and cardanically connected to a part of the machine frame (3) comprising the tubular guides (13).

8. A cutting machine according to claim 1, wherein inner contours of the tubular guides (13) are shaped by use of curved generatrices.

9. A cutting machine according to claim 2, wherein the tubular guides (13) are arranged between crawler mechanisms (2), and the tubular guides (13) are connected to one another by braces or plates (17) extending transversely to longitudinal axes of the tubular guides (13).

10. A cutting machine according to claim 2, wherein a frame part (9) capable of being pivoted about at least one pivot axis (8) extending transversely to the longitudinal direction of the machine is articulately connected to the frame (3) comprising the tubular guides (13).

11. A cutting machine according to claim 3, wherein a frame part (9) capable of being pivoted about at least one pivot axis (8) extending transversely to the longitudinal direction of the machine is articulately connected to the frame (3) comprising the tubular guides (13).

12. A cutting machine according to claim 2, wherein, on a rear end of the carriage (4) facing away from the cutting arm (6), a pivot axis (8) extending transversely to the longitudinal axis of the machine is positioned for pivot of a rear part of the conveyor or a conveying chute.

13. A cutting machine according to claim 3, wherein, on a rear end of the carriage (4) facing away from the cutting arm (6), a pivot axis (8) extending transversely to the longitudinal axis of the machine is positioned for pivot of a rear part of the conveyor or a conveying chute.

14. A cutting machine according to claim 4, wherein, on a rear end of the carriage (4) facing away from the cutting arm (6), a pivot axis (8) extending transversely to the longitudinal axis of the machine is positioned for pivot of a rear part of the conveyor or a conveying chute.

15. A cutting machine, comprising:

a machine frame (3) carrying a chassis;

cutting heads or rollers rotationally mounted on a pivotable cutting arm (6);

a conveyor extending in the direction of a mine face for receiving and removing cut material; and a carriage displaceable on guides extending in a longitudinal direction of the machine, wherein the cutting arm (6) is pivotably mounted on the carriage (4);

the carriage (4) carries guide rods (12) extending in the longitudinal direction of the machine;

the guide rods (12) engage with tubular guides (13) of the machine frame (3);

on a rear end of the carriage (4) facing away from the cutting arm (6), a pivot axis (8) extending transversely to the longitudinal axis of the machine is positioned for pivot of a rear part of the conveyor or a conveying chute; and the cutting machine further comprises a conveyor chute that is designed as an upwardly open chute over an entire length of the conveyor.

16. A cutting machine, comprising:

a machine frame (3) carrying a chassis;

cutting heads or rollers rotationally mounted on a pivotable cutting arm (6);

a conveyor extending in the direction of a mine face for receiving and removing cut material; and a carriage displaceable on guides extending in a longitudinal direction of the machine, wherein the cutting arm (6) is pivotably mounted on the carriage (4);

the carriage (4) carries guide rods (12) extending in the longitudinal direction of the machine;

the guide rods (12) engage with tubular guides (13) of the machine frame (3);

the carriage (4) is designed as an upwardly open chute comprising side cheeks in which is positioned a pivot axis (5) for vertical pivoting of the cutting arm (6); and the cutting machine further comprises a pivotable, rear frame part (10) articulately connected with the machine frame (3), and cardanically connected to a part of the machine frame (3) comprising the tubular guides (13).

17. A cutting machine, comprising:

a machine frame (3) carrying a chassis;

cutting heads or rollers rotationally mounted on a pivotable cutting arm (6);

a conveyor extending in the direction of a mine face .for receiving, and removing cut material; and a carriage displaceable on guides extending in a longitudinal direction of the machine, wherein the cutting arm (6) is pivotably mounted on the carriage (4);

the carriage (4) carries guide rods (12) extending in the longitudinal direction of the machine;

the guide rods (12) engage with tubular guides (13) of the machine frame (3);

the tubular guides (13) are arranged between crawler mechanisms (2), and the tubular guides (13) are connected to one another by braces or plates (17) extending transversely to longitudinal axes of the tubular guides (13); and the cutting machine further comprises a pivotable, rear frame part (10) articulately connected with the machine frame (3), and cardanically connected to a part of the machine frame (3) comprising the tubular guides (13).

18. A cutting machine, comprising:

a machine frame (3) carrying a chassis;

cutting heads or rollers rotationally mounted on a pivotable cutting arm (6);

a conveyor extending in the direction of a mine face for receiving and removing cut material; and a carriage displaceable on guides extending in a longitudinal direction of the machine, wherein the cutting arm (6) is pivotably mounted on the carriage (4);

the carriage (4) carries guide rods (12) extending in the longitudinal direction of the machine;

the guide rods (12) engage with tubular guides (13) of the machine frame (3);

on a rear end of the carriage (4) facing away from the cutting arm (6), a pivot axis (8) extending transversely to the longitudinal axis of the machine is positioned for pivot of a rear part of the conveyor or a conveying chute; and the cutting machine further comprises a pivotable, rear frame part (10) articulately connected with the machine frame (3), and cardanically connected to a part of the machine frame (3) comprising the tubular guides (13).

19. A cutting machine according to claim 2, wherein inner contours of the tubular guides (13) are shaped by use of curved generatrices.

20. A cutting machine, comprising:

a machine frame (3) carrying a chassis;

cutting heads or rollers rotationally mounted on a pivotable cutting arm (6);

a conveyor extending in the direction of a mine face for receiving and removing cut material;

a carriage displaceable on guides extending in a longitudinal direction of the machine;

a conveyor chute that is designed as an upwardly open chute over an entire length of the conveyor; and a pivotable, rear frame part (10) articulately connected with the machine frame (3), and cardanically connected to a part of the machine frame (3) comprising the tubular guides (13), wherein the cutting arm (6) is pivotably mounted on the carriage (4), the carriage (4) carries guide rods (12) extending in the longitudinal direction of the machine, the guide rods (12) engage with tubular guides (13) of the machine frame (3), the carriage (4) is designed as an upwardly open chute comprising side cheeks in which is positioned a pivot axis (5) for vertical pivoting of the cutting arm (6), the tubular guides (13) are arranged between crawler mechanisms (2), and the tubular guides (13) are connected to one another by braces or plates (17) extending transversely to longitudinal axes of the tubular guides (13), a frame part (9) capable of being pivoted about at least one pivot axis (8) extending transversely to the longitudinal direction of the machine is articulately connected to the frame (3) comprising the tubular guides (13), and inner contours of the tubular guides (13) are shaped by use of curved generatrices.

* * * * *